US008642523B2

(12) United States Patent
Crouthamel et al.

(10) Patent No.: US 8,642,523 B2
(45) **Date of Patent: *Feb. 4, 2014**

(54) METHOD FOR IMPROVING THE FUEL EFFICIENCY OF ENGINE OIL COMPOSITIONS FOR LARGE LOW AND MEDIUM SPEED ENGINES BY REDUCING THE TRACTION COEFFICIENT

(75) Inventors: Kevin L. Crouthamel, Richboro, PA (US); Vincent M. Carey, Sewell, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 337 days.

This patent is subject to a terminal disclaimer.

(21) Appl. No.: 13/016,496

(22) Filed: Jan. 28, 2011

(65) Prior Publication Data

US 2011/0195884 A1 Aug. 11, 2011

Related U.S. Application Data

(60) Provisional application No. 61/337,204, filed on Feb. 1, 2010.

(51) Int. Cl.
*C10M 111/00* (2006.01)
*C10M 111/04* (2006.01)

(52) U.S. Cl.
USPC ..... 508/591; 208/19; 585/10; 585/12; 508/460

(58) Field of Classification Search
USPC ..... 508/591
See application file for complete search history.

(56) References Cited

U.S. PATENT DOCUMENTS

| | | | |
|---|---|---|---|
| 2,978,442 | A | 4/1961 | Brightbill et al. |
| 3,149,178 | A | 9/1964 | Hamilton et al. |
| 3,164,578 | A | 1/1965 | Baker et al. |
| 3,382,291 | A | 5/1968 | Brennan |
| 3,576,923 | A | 4/1971 | Pendell et al. |
| 3,742,082 | A | 6/1973 | Brennan |
| 3,769,363 | A | 10/1973 | Brennan |
| 3,780,128 | A | 12/1973 | Shubkin |

(Continued)

FOREIGN PATENT DOCUMENTS

| | | |
|---|---|---|
| EP | 0119069 A2 | 9/1984 |
| EP | 0119792 A1 | 9/1984 |

(Continued)

OTHER PUBLICATIONS

Ferdinand Rodrigues, "The Molecular Weight of Polymers in Principles of Polymer Systems", Chapter 6, McGraw-Hill, 1970, pp. 115-144.

(Continued)

*Primary Examiner* — Ellen McAvoy
(74) *Attorney, Agent, or Firm* — Robert A. Migliorini; Derek M. Kato

(57) ABSTRACT

The present invention is directed to a method for improving the fuel efficiency of engine oil compositions by reducing the traction coefficient of the oil by formulating the oil using a blend of one or more first base stock(s) selected from Group II base stock, Group III base stock and Group IV base stock and a second base stock selected from polyisobutylene (PIB) and, preferably, additized with a detergent.

21 Claims, 3 Drawing Sheets

(56) References Cited

U.S. PATENT DOCUMENTS 3,876,720 A 4/1975 Heilman et al.
3,883,417 A 5/1975 Woo et al.
4,016,349 A 4/1977 McKenna
4,056,122 A 11/1977 Schlieckmann
4,132,663 A 1/1979 Heilman et al.
4,149,178 A 4/1979 Estes
4,172,855 A 10/1979 Shubkin et al.
4,218,330 A 8/1980 Shubkin
4,234,435 A 11/1980 Meinhardt et al.
4,239,930 A 12/1980 Allphin et al.
4,263,150 A 4/1981 Clason et al.
4,263,465 A 4/1981 Sheng et al.
4,289,635 A 9/1981 Schroeck
4,308,154 A 12/1981 Clason et al.
4,367,352 A 1/1983 Watts, Jr. et al.
4,413,156 A 11/1983 Watts, Jr. et al.
4,417,990 A 11/1983 Clason et al.
4,434,408 A 2/1984 Baba et al.
4,451,684 A 5/1984 Pasky
4,469,912 A 9/1984 Blewett et al.
4,587,368 A 5/1986 Pratt
4,652,416 A 3/1987 Millot
4,701,489 A 10/1987 Hughes et al.
4,704,491 A 11/1987 Tsutsui et al.
4,776,967 A 10/1988 Ichihashi et al.
4,827,064 A 5/1989 Wu
4,827,073 A 5/1989 Wu
4,892,851 A 1/1990 Ewen et al.
4,906,350 A 3/1990 Lucien et al.
4,906,799 A 3/1990 Forbus, Jr. et al.
4,910,355 A 3/1990 Shubkin et al.
4,912,272 A 3/1990 Wu
4,914,254 A 4/1990 Pelrine
4,922,046 A 5/1990 Kinoshita et al.
4,926,004 A 5/1990 Pelrine et al.
4,943,383 A 7/1990 Avery et al.
4,950,822 A 8/1990 Dileo et al.
4,956,122 A 9/1990 Watts et al.
4,962,249 A 10/1990 Chen et al.
4,962,262 A 10/1990 Winter et al.
4,967,032 A 10/1990 Ho et al.
4,990,709 A 2/1991 Wu
4,990,711 A 2/1991 Chen et al.
5,012,020 A 4/1991 Jackson et al.
5,017,299 A 5/1991 Gutierrez et al.
5,017,714 A 5/1991 Welborn, Jr.
5,057,235 A 10/1991 Farng et al.
5,068,487 A 11/1991 Theriot
5,075,269 A 12/1991 Degnan et al.
5,087,788 A 2/1992 Wu
5,104,579 A 4/1992 Benjamin et al.
5,105,038 A 4/1992 Chen et al.
5,113,030 A 5/1992 Chen et al.
5,132,478 A 7/1992 Ho et al.
5,146,021 A 9/1992 Jackson et al.
5,157,177 A 10/1992 Pelrine et al.
5,177,276 A 1/1993 Beach et al.
5,180,865 A 1/1993 Heilman et al.
5,186,851 A 2/1993 Gutierrez et al.
5,187,250 A 2/1993 Asanuma et al.
5,188,724 A 2/1993 Heilman et al.
5,188,746 A 2/1993 Davis
5,190,682 A 3/1993 Harris
5,208,403 A 5/1993 Buchanan et al.
5,220,100 A 6/1993 Massie et al.
5,243,114 A 9/1993 Johnson et al.
5,254,274 A 10/1993 Ho et al.
5,264,642 A 11/1993 Wu
5,275,749 A 1/1994 Kugel et al.
5,276,227 A 1/1994 Wu et al.
5,276,277 A 1/1994 Hightower et al.
5,315,053 A 5/1994 Beach et al.
5,369,196 A 11/1994 Matsumoto et al.
5,382,739 A 1/1995 Atkins et al.
5,436,379 A 7/1995 Heilman et al.
5,462,995 A 10/1995 Hosaka et al.
5,498,815 A 3/1996 Schaerfl, Jr. et al.
5,602,086 A 2/1997 Le et al.
5,679,812 A 10/1997 Winter et al.
5,688,887 A 11/1997 Bagheri et al.
5,705,577 A 1/1998 Rossi et al.
5,726,133 A 3/1998 Blahey et al.
5,731,254 A 3/1998 Winter et al.
5,807,949 A 9/1998 Rossi et al.
5,811,379 A 9/1998 Rossi et al.
5,817,605 A 10/1998 Papay
5,846,896 A 12/1998 Ewen
5,852,143 A 12/1998 Sishta et al.
5,858,935 A 1/1999 Watts et al.
5,859,159 A 1/1999 Rossi et al.
6,043,401 A 3/2000 Bagheri et al.
6,080,301 A 6/2000 Berlowitz et al.
6,087,307 A 7/2000 Kaminski et al.
6,090,989 A 7/2000 Trewella et al.
6,133,209 A 10/2000 Rath et al.
6,140,281 A 10/2000 Blahey et al.
6,143,701 A * 11/2000 Boffa ..... 508/363
6,147,271 A 11/2000 Strebel et al.
6,165,949 A 12/2000 Berlowitz et al.
6,180,575 B1 1/2001 Nipe
6,184,186 B1 2/2001 Ryan et al.
6,191,081 B1 2/2001 Cartwright et al.
6,339,051 B1 1/2002 Carey et al.
6,388,032 B1 5/2002 Yamaura et al.
6,395,948 B1 5/2002 Hope et al.
6,414,090 B2 7/2002 Minami et al.
6,429,178 B1 8/2002 Skinner et al.
6,479,722 B1 11/2002 De Wet et al.
6,548,723 B2 4/2003 Bagheri et al.
6,548,724 B2 4/2003 Bagheri et al.
6,589,920 B2 7/2003 Okada et al.
6,613,724 B2 9/2003 Strickland et al.
6,642,169 B2 11/2003 Weatherhead
6,645,922 B2 11/2003 Dunn et al.
6,646,174 B2 11/2003 Clarembeau
6,706,828 B2 3/2004 DiMaio
6,713,438 B1 3/2004 Baillargeon et al.
6,790,813 B2 * 9/2004 Boffa ..... 508/198
6,824,671 B2 11/2004 Goze et al.
6,858,767 B1 2/2005 DiMaio et al.
6,869,917 B2 3/2005 Deckman et al.
7,022,784 B2 4/2006 Wu et al.
7,045,055 B2 5/2006 Ziemer et al.
7,060,768 B2 6/2006 Brookhart et al.
7,101,830 B2 9/2006 Owen et al.
7,129,197 B2 10/2006 Song et al.
7,312,185 B2 12/2007 Willey et al.
7,407,919 B2 * 8/2008 Wilk et al. ..... 508/399
7,476,645 B2 * 1/2009 Rosenbaum et al. ..... 508/110
7,544,850 B2 6/2009 Goze et al.
7,547,811 B2 6/2009 Kramer et al.
7,585,820 B2 * 9/2009 Kleijwegt ..... 508/192
7,585,823 B2 9/2009 Sullivan et al.
7,592,411 B2 9/2009 Wu et al.
7,592,497 B2 9/2009 Yang et al.
7,683,013 B2 * 3/2010 Carey et al. ..... 508/110
7,704,930 B2 * 4/2010 Deckman et al. ..... 508/460
7,795,194 B2 9/2010 Iimura et al.
7,989,408 B2 * 8/2011 Poirier et al. ..... 508/486
8,105,991 B2 * 1/2012 Dowding et al. ..... 508/391
8,143,200 B2 * 3/2012 Vaughn et al. ..... 508/110
8,299,007 B2 * 10/2012 Carey et al. ..... 508/591
2001/0041817 A1 11/2001 Bagheri et al.
2001/0041818 A1 11/2001 Bagheri et al.
2002/0144853 A1 10/2002 Martin
2003/0013623 A1 1/2003 Tse et al.
2003/0055184 A1 3/2003 Song et al.
2003/0092585 A1 5/2003 O'Connor et al.
2003/0158055 A1 8/2003 Deckman et al.
2003/0191032 A1 10/2003 Deckman et al.
2003/0207775 A1 11/2003 Sullivan et al.
2003/0236177 A1 12/2003 Wu et al.
2004/0002429 A1 1/2004 Forbus, Jr.
2004/0029747 A1 2/2004 Emert et al.

(56) References Cited

U.S. PATENT DOCUMENTS

| | | | | |
|---|---|---|---|---|
| 2004/0033908 | A1 | 2/2004 | Deckman et al. | |
| 2004/0087746 | A1 | 5/2004 | Razavi | |
| 2004/0092408 | A1 | 5/2004 | Willey et al. | |
| 2004/0097772 | A1 | 5/2004 | Deckers et al. | |
| 2004/0147693 | A1 | 7/2004 | DiMaio | |
| 2004/0214733 | A1 | 10/2004 | Baba | |
| 2004/0220359 | A1 | 11/2004 | Abhari et al. | |
| 2004/0225088 | A1 | 11/2004 | Vaughan et al. | |
| 2004/0230016 | A1 | 11/2004 | Blackborow et al. | |
| 2005/0059563 | A1 | 3/2005 | Sullivan et al. | |
| 2005/0101761 | A1 | 5/2005 | Lambert et al. | |
| 2005/0113621 | A1 | 5/2005 | Hope et al. | |
| 2005/0124509 | A1 | 6/2005 | Gutierrez et al. | |
| 2005/0148478 | A1 | 7/2005 | Ozbalik et al. | |
| 2005/0183988 | A1 | 8/2005 | Freerks et al. | |
| 2005/0250657 | A1 | 11/2005 | Wu et al. | |
| 2006/0116300 | A1 | 6/2006 | Arrowsmith et al. | |
| 2006/0116303 | A1 | 6/2006 | Iimura et al. | |
| 2006/0122073 | A1 | 6/2006 | Hewette | |
| 2006/0131210 | A1 | 6/2006 | Rosenbaum et al. | |
| 2006/0157383 | A1 | 7/2006 | Wu et al. | |
| 2006/0178279 | A1 | 8/2006 | Sullivan et al. | |
| 2006/0199743 | A1 | 9/2006 | Rosenbaum et al. | |
| 2006/0270568 | A1 | 11/2006 | Kawata | |
| 2006/0276355 | A1 | 12/2006 | Carey et al. | |
| 2006/0281643 | A1 | 12/2006 | Habeeb et al. | |
| 2007/0000807 | A1 | 1/2007 | Wu et al. | |
| 2007/0043248 | A1 | 2/2007 | Wu et al. | |
| 2007/0208151 | A1 | 9/2007 | Okada et al. | |
| 2007/0289897 | A1 | 12/2007 | Carey et al. | |
| 2007/0298990 | A1 | 12/2007 | Carey et al. | |
| 2008/0020954 | A1 | 1/2008 | Haigh et al. | |
| 2008/0177121 | A1 | 7/2008 | Wu et al. | |
| 2008/0207475 | A1 | 8/2008 | Haigh et al. | |
| 2009/0005279 | A1 | 1/2009 | Wu et al. | |
| 2009/0011963 | A1* | 1/2009 | Anderson et al. | 508/192 |
| 2009/0036725 | A1 | 2/2009 | Wu et al. | |
| 2009/0042753 | A1 | 2/2009 | Poirier et al. | |
| 2009/0088356 | A1 | 4/2009 | Hee et al. | |
| 2009/0093657 | A1 | 4/2009 | Buchanan et al. | |
| 2009/0156874 | A1 | 6/2009 | Patil et al. | |
| 2009/0186784 | A1 | 7/2009 | Diggs et al. | |
| 2009/0240012 | A1 | 9/2009 | Patil et al. | |
| 2010/0006259 | A1 | 1/2010 | Mori et al. | |
| 2010/0048438 | A1 | 2/2010 | Carey et al. | |
| 2010/0062959 | A1* | 3/2010 | Vaughn et al. | 508/591 |
| 2010/0087349 | A1 | 4/2010 | Lee et al. | |
| 2010/0105585 | A1 | 4/2010 | Carey et al. | |
| 2010/0256026 | A1 | 10/2010 | Wu et al. | |
| 2010/0292424 | A1 | 11/2010 | Wu et al. | |
| 2010/0323937 | A1* | 12/2010 | Wu et al. | 508/591 |
| 2011/0082061 | A1 | 4/2011 | Carey et al. | |
| 2011/0082063 | A1 | 4/2011 | Carey et al. | |
| 2011/0136714 | A1* | 6/2011 | Haigh et al. | 508/583 |

FOREIGN PATENT DOCUMENTS

| | | | |
|---|---|---|---|
| EP | 0088453 | B1 | 5/1987 |
| EP | 0276320 | B1 | 8/1988 |
| EP | 0277004 | A1 | 8/1988 |
| EP | 0277007 | B1 | 8/1988 |
| EP | 0284708 | B1 | 10/1988 |
| EP | 0291006 | B1 | 11/1988 |
| EP | 0321852 | B1 | 6/1989 |
| EP | 0349276 | B1 | 1/1990 |
| EP | 0377306 | B1 | 7/1990 |
| EP | 0403866 | A1 | 12/1990 |
| EP | 0513380 | B1 | 11/1992 |
| EP | 0680942 | A1 | 5/1994 |
| EP | 0613873 | A2 | 9/1994 |
| EP | 0930320 | A1 | 7/1997 |
| EP | 1028128 | A1 | 10/1997 |
| EP | 0992517 | A2 | 9/1998 |
| EP | 1309633 | B1 | 8/2000 |
| EP | 1308496 | B1 | 5/2003 |
| EP | 1342707 | A2 | 9/2003 |
| EP | 1607415 | A1 | 12/2005 |
| EP | 1661921 | A1 | 5/2006 |
| GB | 938069 | | 9/1963 |
| IN | 191553 | | 12/2003 |
| JP | 6336590 | A | 12/1994 |
| JP | 2005000446 | A | 7/2005 |
| WO | 9623751 | | 8/1996 |
| WO | 9804658 | | 2/1998 |
| WO | 9967347 | | 6/1999 |
| WO | 99/64543 | | 12/1999 |
| WO | 0058423 | | 10/2000 |
| WO | 0214384 | A2 | 2/2002 |
| WO | 02/083826 | A1 | 10/2002 |
| WO | 03009136 | A1 | 1/2003 |
| WO | 03020856 | A1 | 3/2003 |
| WO | 03051943 | A1 | 6/2003 |
| WO | 03071369 | A1 | 8/2003 |
| WO | 03104292 | A1 | 12/2003 |
| WO | 2004046214 | A2 | 6/2004 |
| WO | 2004053030 | A2 | 6/2004 |
| WO | 2005111178 | A1 | 12/2005 |
| WO | 2006071595 | A2 | 7/2006 |
| WO | 2006083632 | A1 | 8/2006 |
| WO | 2007/011832 | A1 | 1/2007 |
| WO | 2007005094 | A1 | 1/2007 |
| WO | 2007/146081 | A1 | 12/2007 |
| WO | 2007145924 | A1 | 12/2007 |
| WO | 2007146081 | A1 | 12/2007 |
| WO | 2008/011338 | A2 | 1/2008 |
| WO | 2008010865 | A2 | 1/2008 |
| WO | 2008/102114 | A1 | 8/2008 |
| WO | 2009017953 | A2 | 2/2009 |
| WO | 2009/123800 | A1 | 10/2009 |
| WO | 2009137264 | A1 | 11/2009 |

OTHER PUBLICATIONS

S. T. Orszulik, "Chemistry and Technology of Lubricants, Passage", Jan. 1, 1992, pp. 243-245.

J. Brennan, "Wide-Temperature Range Synthetic Hydrocarbon Fluids", Ind. Eng. Chem. Prod. Res. Dev., 1980, vol. 19, pp. 2-6.

K. Denbigh, "The Kinetics of Continuous Reaction Processes: Application to Polymerization", J. Applied Chem, 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.

G. Gokel, ed., "Dean's Handbook of Organic Chemistry", 2nd Edition, McGraw-Hill, 2004, available on-line at hhtp://knovel.com.

M. LeVan, et al., "Adsorption and Ion Exchange", Perry's Chemical Engineer's Handbook, 7th ed., 1997, pp. 16-1-16-66.

O. Levenspiel, "Ch. 7: Design for Multiple Reactions", Chemical Reaction Engineering, 2nd ed., 1972, pp. 196-209.

N. Naga, et al.. "Effect of Co-Catalyst System on a-Olefin Polymerization with Rac- and Meso-[Dimethylsilylenebis (2,3,5-Trimethyl-Cyclopentadienyl)] Zirconium Dichloride", Macromol. Rapid Commun., 1997, vol. 18, pp. 581-589.

N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200. pp. 1587-1594.

F. Rodriguez, "The Molecular Weight of Polymers", Principles of Polymer Systems, 1970, Chapter 6, pp. 115-144.

M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.

(56) References Cited

OTHER PUBLICATIONS

T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.
J. Wills, "Synthetic Lubricants", Lubrication Fundamentals, Marcel Dekker Inc., New York, 1980, pp. 75-80.
"Mobil Releases SuperSyn PAO's", Lubrication Engineers, 1999, vol. 55, Part 8, pp. 45.
TIBA data, "TIBA datasheet" available on-line at www.albermarle.com on Aug. 26, 2010.
ASTM D3427-03, "Standard Test Method for Air Release Properties of Petroleum Oils".
http://www.mobil.com/USA, Mobilgear® SHC XMP Series.
http://www.famm11c.com/famm/lubricant_productasp?gearoils&& wPinnacleMarineGear220, Pinnacle® Marine Gear 220.
Rudnick, Leslie R., "Synthetics, Mineral Oils, and Bio-Based Lubricants Chemistry and Technology", published by CRC Press, Taylor & Francis Group, 2006, 37-46.
Corsico, G., et al., "Poly(internal olefins)", EURON, Milan, Italy, Chemical Industries (Dekker), 1999, 77(Synthetic Lubricants and High-Performance Functional Fluids, 2nd Edition, 53-62.
Kirk-Othmer Encyclopedia of Chemcial Technology, Second completely revised edition, "Diamines and Higher Amines, Aliphatic", vol. 7, 1965, published by John Wiley & Sons, Inc., 22-39.

* cited by examiner

METHOD FOR IMPROVING THE FUEL EFFICIENCY OF ENGINE OIL COMPOSITIONS FOR LARGE LOW AND MEDIUM SPEED ENGINES BY REDUCING THE TRACTION COEFFICIENT

This application claims benefit of U.S. Provisional Application No. 61/337,204 filed Feb. 1, 2010.

BACKGROUND OF THE INVENTION

1. Field of the Invention

The present invention relates to the operation of large low and medium speed engines using lubricating oil formulations.

2. Description of the Related Art

Diesel engines designed for marine and stationary power applications can be either 2-stroke or 4-stroke cycle having up to 20 cylinders and are typically classified as low-speed, medium-speed or high-speed diesel engines. These engines burn a wide variety of fuels ranging from residual or heavy fuel oils to natural gas (diesel compression or spark-ignited) and are most commonly used for marine propulsion, marine auxiliary (vessel electricity generation), distributed power generation, and combined heating and power (CHP). Lubrication of such engines can be all-loss (i.e., lubricant fed directly to the cylinder by cylinder oil) or recirculation involving oil sumps. Lubrication of critical engine parts includes piston rings, cylinder liners, bearings, piston cooling, fuel pump, engine control hydraulics, etc. Fuel is typically the major cost of operating these engines and a typical 12 cylinder, 90 cm bore low-speed diesel engine used in marine vessel container service will burn up to approximately $33M of heavy fuel per year at today's price of $480/MT. Therefore, a fuel efficiency gain of as little as 1% would result in approximately up to $330 k annual savings to the ship operator. In addition, governmental organizations, such as the International Marine Organization, U.S. Environmental Protection Agency and the California Air Resources Board are legislating emissions requirements for these engines Improving fuel efficiency will reduce emissions ($CO_2$, $SO_x$, $NO_x$ and Particulate Matter) commensurately which should result in some emissions credit trading value.

Because the lubricant is subjected to a constant high temperature environment, the life of the lubricant is often limited by its oxidation stability. Moreover, because the engines run with high emission of nitrogen oxides ($NO_x$), the lubricant life may also be limited by its nitration resistance. A longer term requirement is that the lubricant must also maintain cleanliness within the high temperature environment of the engine, especially for critical components such as the piston and piston rings. Therefore, it is desirable for these engine oils to have good cleanliness qualities while promoting long life through enhanced resistance to oxidation and nitration.

U.S. Pat. No. 6,339,051 is directed to a diesel engine cylinder oil of improved cleanliness and load carrying ability and reduced port deposit characteristics for use in marine and stationary slow speed diesel engines comprising a medium heavy Group I or Group II neutral base oil, typically 300 to 500-600 SUS (KV at 100° C. of about 12 $mm^2/s$ and less) in combination with a liquid, oil miscible polyisobutylene (PIB) and an additive package comprising a detergent, preferably one or more of an overbased phenate, phenylate, salicylate or sulfonate, an anti-oxidant, an anti-wear agent and a dispersant. The finished lubricant has a KV at 100° C. in the range 15 to 25 $mm^2/s$ and a Total Base Number in the range 40 to 100 mg KOH/g.

Gas engine oil of enhanced life as evidenced by an increase in the resistance of the oil to oxidation, nitration and deposit formation is the subject of U.S. Pat. No. 5,726,133. The gas engine oil of that patent is a low ash gas engine oil comprising a major amount of a base oil of lubricating viscosity and a minor amount of an additive mixture comprising a mixture of detergents comprising at least one alkali or alkaline earth metal salt having a Total Base Number (TBN) of about 250 and less and a second alkali or alkaline earth metal salt having a TBN lower than the aforesaid component. The TBN of this second alkali or alkaline earth metal salt will typically be about half or less that of the aforesaid component.

The fully formulated gas engine oil of U.S. Pat. No. 5,726,133 can also typically contain other standard additives known to those skilled in the art, including dispersants (about 0.5 to 8 vol %), phenolic or aminic anti-oxidants (about 0.05 to 1.5 vol %), metal deactivators such as triazoles, alkyl-substituted dimercaptothiadiazoles (about 0.01 to 0.2 vol %), anti-wear additives such as metal dithiophosphates, metal dithiocarbamates, metal xanthates or tricresylphosphates (about 0.05 to 1.5 vol %), pour point depressants such as poly(meth) acrylates or alkyl aromatic polymers (about 0.05-0.6 vol %), anti-foamants such as silicone anti-foaming agents (about 0.005 to 0.15 vol %) and viscosity index improvers, such as olefin copolymers, polymethacrylates, styrene-diene block copolymers, and star copolymers (up to about 15 vol %, preferably up to about 10 vol %).

U.S. Pat. No. 6,191,081 is directed to a lubricating oil composition for natural gas engines comprising a major amount of a base oil of lubricating viscosity and a minor amount of a mixture of one or more metal salicylate detergents and one or more metal phenate(s) and/or metal sulfonate detergents.

The lubricating oil base stock is any natural or synthetic lubricating base oil stock fraction typically having a kinematic viscosity at 100° C. of about 5 to 20 cSt. In a preferred embodiment, the use of the viscosity index improver permits the omission of oil of viscosity about 20 cSt or more at 100° C. from the lube base oil fraction used to make the present formulation. Therefore, a preferred base oil is one which contains little, if any, heavy fraction; e.g., little, if any, lube oil fraction of viscosity 20 cSt or higher at 100° C.

The lubricating oil base stock can be derived from natural lubricating oils, synthetic lubricating oils or mixtures thereof. Suitable lubricating oil base stocks include base stocks obtained by isomerization of synthetic wax and slack wax, as well as hydrocrackate base stocks produced by hydrocracking (rather than solvent extracting) the aromatic and polar components of the crude. Suitable base stocks include those in API categories I, II and III, where saturates level and Viscosity Index are:

Group I—less than 90% and 80-120, respectively;

Group II—greater than 90% and 80-120, respectively; and

Group III—greater than 90% and greater than 120, respectively.

The mixture of detergents comprises a first metal salt or group of metal salts selected from the group consisting of one or more metal sulfonates(s), salicylate(s), phenate(s) and mixtures thereof having a high TBN of greater than about 150 to 300 or higher used in an amount in combination with the other metal salts or groups of metal salts (recited below) sufficient to achieve a lubricating oil of at least 0.65 wt % sulfated ash content, a second metal salt or group of metal salts selected from the group consisting of one or more metal salicylate(s), metal sulfonate(s), metal phenate(s) and mixtures thereof having a medium TBN of greater than about 50 to 150 and a third metal salt or group of metal salts selected from the group consisting of one or more metal sulfonate(s), metal salicylate(s) and mixtures thereof identified as neutral or low TBN, having a TBN of about 10 to 50, the total amount of medium plus neutral/low TBN detergent being about 0.7 vol % or higher (active ingredient), wherein at least one of the medium or low/neutral TBN detergent(s) is metal salicylate, preferably at least one of the medium TBN detergent(s) is a metal salicylate. The total amount of high TBN detergents is about 0.3 vol % or higher (active ingredient). The mixture contains salts of at least two different types, with medium or neutral salicylate being an essential component. The volume ratio (based on active ingredient) of the high TBN detergent to medium plus neutral/low TBN detergent is in the range of about 0.15 to 3.5.

The mixture of detergents is added to the lubricating oil formulation in an amount up to about 10 vol % based on active ingredient in the detergent mixture, preferably in an amount up to about 8 vol % based on active ingredient, more preferably 6 vol % based on active ingredient in the detergent mixture, most preferably between about 1.5 to 5.0 vol %, based on active ingredient in the detergent mixture. Preferably, the total amount of metal salicylate(s) used of all TBNs is in the range of between 0.5 vol % to 4.5 vol %, based on active ingredient of metal salicylate.

U.S. Published Application US2005/0059563 is directed to a lubricating oil composition, automotive gear lubricating composition and fluids useful in the preparation of finished automotive gear lubricants and gear oil comprising a blend of a PAO having a viscosity of between about 40 cSt ($mm^2/s$) and 1000 cSt ($mm^2/s$) @ 100° C., and an ester having a viscosity of less than or equal to about 2.0 cSt ($mm^2/s$) @ 100° C. wherein the blend of PAO and ester has a viscosity index greater than or equal to the viscosity index of the PAO. The composition may further contain thickeners, anti-oxidants, inhibitor packages, anti-rust additives, dispersants, detergents, friction modifiers, traction improving additives, demulsifiers, defoamants, dyes and haze inhibitors.

U.S. Published Application US2003/0191032 is directed to a detergent additive for lubricating oil compositions comprising at least two of low, medium and high TBN detergents, preferably a calcium salicylate. The detergent is in a lubricating oil composition comprising at least one of Group II base stock, Group III base stock or wax isomerate base stock and mixtures thereof, and an optional minor quantity of a co-base stock(s). Co-base stocks include polyalpha olefin oligomeric low and medium and high viscosity oil, di-basic acid esters, polyol esters, other hydrocarbon oils, supplementary hydrocarbyl aromatics and the like.

US Published Application 2006/0276355 is directed to a lubricant blend for enhanced micropitting properties wherein the lubricant comprises at least two base stocks with a viscosity difference between the first and second base stock of greater than 96 cSt ($mm^2/s$) @ 100° C. At least one base stock is a polyalpha olefin with a viscosity of less than 6 cSt ($mm^2/s$) but greater than 2 cSt ($mm^2/s$), and the second base stock is a synthetic oil with a viscosity greater than 100 cSt ($mm^2/s$) but less than 300 cSt ($mm^2/s$) @ 100° C. The second base stock can be a high viscosity polyalpha olefin.

U.S. Published Application 2007/0289897 is directed to a lubricating oil blend comprising at least two base stocks with a viscosity difference between the first and second base stock of greater than 96 cSt ($mm^2/s$) @ 100° C., the lubricant exhibiting improved air release. The blend contains at least one synthetic PAO having a viscosity of less than 10 cSt ($mm^2/s$) but greater than 2 cSt ($mm^2/s$) @ 100° C. and a second synthetic oil having a viscosity greater than 100 cSt ($mm^2/s$) but less than 300 cSt ($mm^2/s$) @ 100° C. The lubricant can contain anti-wear, anti-oxidant, defoamant, demulsifier, detergent, dispersant, metal passivator, friction reducer, rust inhibitor additive and mixtures thereof.

U.S. Published Application 2007/0298990 is directed to a lubricating oil comprising at least two base stocks, the first base stock has a viscosity greater than 40 cSt ($mm^2/s$) @ 100° C. and a molecular weight distribution (MWD) as a function of viscosity at least 10% less than algorithm:

$$MWD=0.2223+1.0232*\log(Kv \text{ at } 100^\circ \text{ C. in cSt})$$

and a second base stock with a viscosity less than 10 cSt ($mm^2/s$) @ 100° C. Preferably the difference in viscosity between the first and second stocks is greater than 30 cSt ($mm^2/s$) @ 100° C. Preferably the high viscosity first stock is a metallocene catalyzed PAO base stock. The second stock can be selected from GTL lubricants, wax-derived lubricants, PAO, brightstock, brightstock with PIB, Group I base stocks, Group II base stocks, Group III base stocks and mixtures thereof. The lubricant can contain additives including detergents. Preferably the first stock has a viscosity of greater than 300 cSt ($mm^2/s$) @ 100° C., the second stock has a viscosity of between 1.5 cSt ($mm^2/s$) to 6 cSt ($mm^2/s$) @ 100° C. Preferably the difference in viscosity between the first and second stocks is greater than 96 cSt ($mm^2/s$) @ 100° C.

U.S. Published Application US2008/0207475 is directed to a lubricating oil comprising at least two base stocks, the first base stock having a viscosity of at least 300 cSt ($mm^2/s$) @ 100° C. and a molecular weight distribution (MSD) as a function of viscosity at least 10% less than algorithm:

$$MWD=0.2223+1.0232*\log(KV @ 100^\circ \text{ C. in cSt})$$

and the second stock has a viscosity of less than 100 cSt ($mm^2/s$) @ 100° C. Preferably the difference in viscosity between the first and second stocks is greater than 250 cSt ($mm^2/s$) @ 100° C. Preferably the first stock is a metallocene catalyzed PAO base stock. The second stock can be chosen from GTL base stock, wax-derived base stock, PAO, brightstock, brightstock with PIB, Group I base stock, Group II base stock, Group III base stock, Group V base stock, Group VI base stock and mixtures thereof. The lubricant can contain additives including detergents.

U.S. Pat. No. 6,140,281 is directed to long life gas engine lubricating oils containing detergents. The lubricating oil comprises a major amount of a base oil of lubricating viscosity and a minor amount of a mixture of one or more metal sulfonate(s) and/or phenate(s) and one or more metal salicylate(s) detergents, all detergents in the mixture having the same or substantially the same Total Base Number (TBN).

The lubricating oil base stock is any natural or synthetic lubricating base stock fraction typically having a kinematic viscosity at 100° C. of about 5 to 20 cSt. In a preferred embodiment, the use of the viscosity index improver permits the omission of oil of viscosity 20 cSt or more at 100° C. from the lube base oil fraction used to make the present formulation. Therefore, a preferred base oil is one which contains little, if any, heavy fractions; e.g., little, if any, lube oil fraction of viscosity 20 cSt or higher at 100° C.

The lubricating oil base stock can be derived from natural lubricating oils, synthetic lubricating oils or mixtures thereof. Suitable base stocks include those in API categories I, II and III, where saturates level and Viscosity Index are:

Group I—less than 90% and 80-120, respectively;

Group II—greater than 90% and 80-120, respectively; and

Group III—greater than 90% and greater than 120, respectively.

Suitable lubricating oil base stocks include base stocks obtained by isomerization of synthetic wax and slack wax, as well as hydrocrackate base stocks produced by hydrocracking (rather than solvent extracting) the aromatic and polar components of the crude.

The detergent is a mixture of one or more metal sulfonate(s) and/or metal phenate(s) with one or more metal salicylate(s). The metals are any alkali or alkaline earth metals; e.g., calcium, barium, sodium, lithium, potassium, magnesium, more preferably calcium, barium and magnesium. It is a feature of the lubricating oil that each of the metal salts used in the mixture has the same or substantially the same TBN as the other metal salts in the mixture.

The TBNs of the salts will differ by no more than about 15%, preferably no more than about 12%, more preferably no more than about 10% or less.

The one or more metal sulfonate(s) and/or metal phenate(s), and the one or more metal salicylate(s) are utilized in the detergent as a mixture, for example, in a ratio by parts of 5:95 to 95:5, preferably 10:90 to 90:10, more preferably 20:80 to 80:20.

The mixture of detergents is added to the lubricating oil formulation in an amount up to about 10 vol % based on active ingredient in the detergent mixture, preferably in an amount up to about 8 vol % based on active ingredient.

U.S. Pat. No. 6,645,922 is directed to a lubricating oil for two-stroke cross-head marine diesel engines comprising a base oil and an oil-soluble overbased detergent additive in the form of a complex wherein the basic material of the detergent is stabilized by more than one surfactant. The more than one surfactants can be mixtures of: (1) sulfurized and/or non-sulfurized phenols and one other surfactant which is not a phenol surfactant; (2) sulfurized and/or non-sulfurized salicylic acid and one other surfactant which is not a salicylic surfactant; or (3) at least three surfactants which are sulfurized or non-sulfurized phenol, sulfurized or non-sulfurized salicylic acid and one other surfactant which is not a phenol or salicylic surfactant; or (4) at least three surfactants which are sulfurized or non-sulfurized phenol, sulfurized or non-sulfurized salicylic acid and at least one sulfuric acid surfactant.

The base stock is an oil of lubricating viscosity and may be any oil suitable for the system lubrication of a cross-head engine. The lubricating oil may suitably be an animal, vegetable or a mineral oil. Suitably the lubricating oil is a petroleum-derived lubricating oil, such as naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example, liquid polyisobutene and polyalpha olefins. Commonly, a mineral oil is employed. The lubricating oil may generally comprise greater than 60, typically greater than 70, % by mass of the lubricating oil composition and typically have a kinematic viscosity at 100° C. of from 2 to 40, for example, from 3 to 15, $mm^2/s$, and a viscosity index from 80 to 100, for example, from 90 to 95.

Another class of lubricating oil is hydrocracked oils, where the re fining process further breaks down the middle and heavy distillate fractions in the presence of hydrogen at high temperatures and moderate pressures. Hydrocracked oils typically have kinematic viscosity at 100° C. of from 2 to 40, for example, from 3 to 15, $mm^2/s$, and a viscosity index typically in the range of from 100 to 110, for example, from 105 to 108.

Brightstock refers to base oils which are solvent-extracted, de-asphalted products from vacuum residuum generally having a kinematic viscosity at 100° C. from 28 to 36 $mm^2/s$, and are typically used in a proportion of less than 30, preferably less than 20, more preferably less than 15, most preferably less than 10, such as less than 5 mass %, based on the mass of the lubricating oil composition.

U.S. Pat. No. 6,613,724 is directed to gas fueled engine lubricating oil comprising an oil of lubricating viscosity, a detergent including at least one calcium salicylate having a TBN in the range 70 to 245, 0 to 0.2 mass % of nitrogen, based on the mass of the oil composition, of a dispersant and minor amounts of one or more co-additive. The base oil can be any animal, vegetable or mineral oil or synthetic oil. The base oil is used in a proportion of greater than 60 mass % of the composition. The oil typically has a viscosity at 100° C. of from 2 to 40, for example 3 to 15 $mm^2/s$ and a viscosity index of from 80 to 100. Hydrocracked oils can also be used which have viscosities of 2 to 40 $mm^2/s$ at 100° C. and viscosity indices of 100 to 110. Brightstock having a viscosity at 100° C. of from 28 to 36 $mm^2/s$ can also be used, typically in a proportion less than 30, preferably less than 20, most preferably less than 5 mass %.

U.S. Pat. No. 7,101,830 is directed to a gas engine oil having a boron content of more than 95 ppm comprising a major amount of a lubricating oil having a viscosity index of 80 to 120, at least 90 mass % saturates, 0.03 mass % or less sulfur and at least one detergent. Metal salicylate is a preferred detergent.

U.S. Pat. No. 4,956,122 is directed to a lubricating oil composition containing a high viscosity synthetic hydrocarbon such as high viscosity PAO, liquid hydrogenated polyisoprenes, or ethylene-alpha olefin copolymers having a viscosity of 40-1000 cSt ($mm^2/s$) at 100° C., a low viscosity synthetic hydrocarbon having a viscosity of between 1 and 10 cSt ($mm^2/s$) at 100° C., optionally a low viscosity ester having a viscosity of between 1 and 10 cSt ($mm^2/s$) at 100° C. and optionally up to 25 wt % of an additive package.

DESCRIPTION OF THE INVENTION

Figure 1:
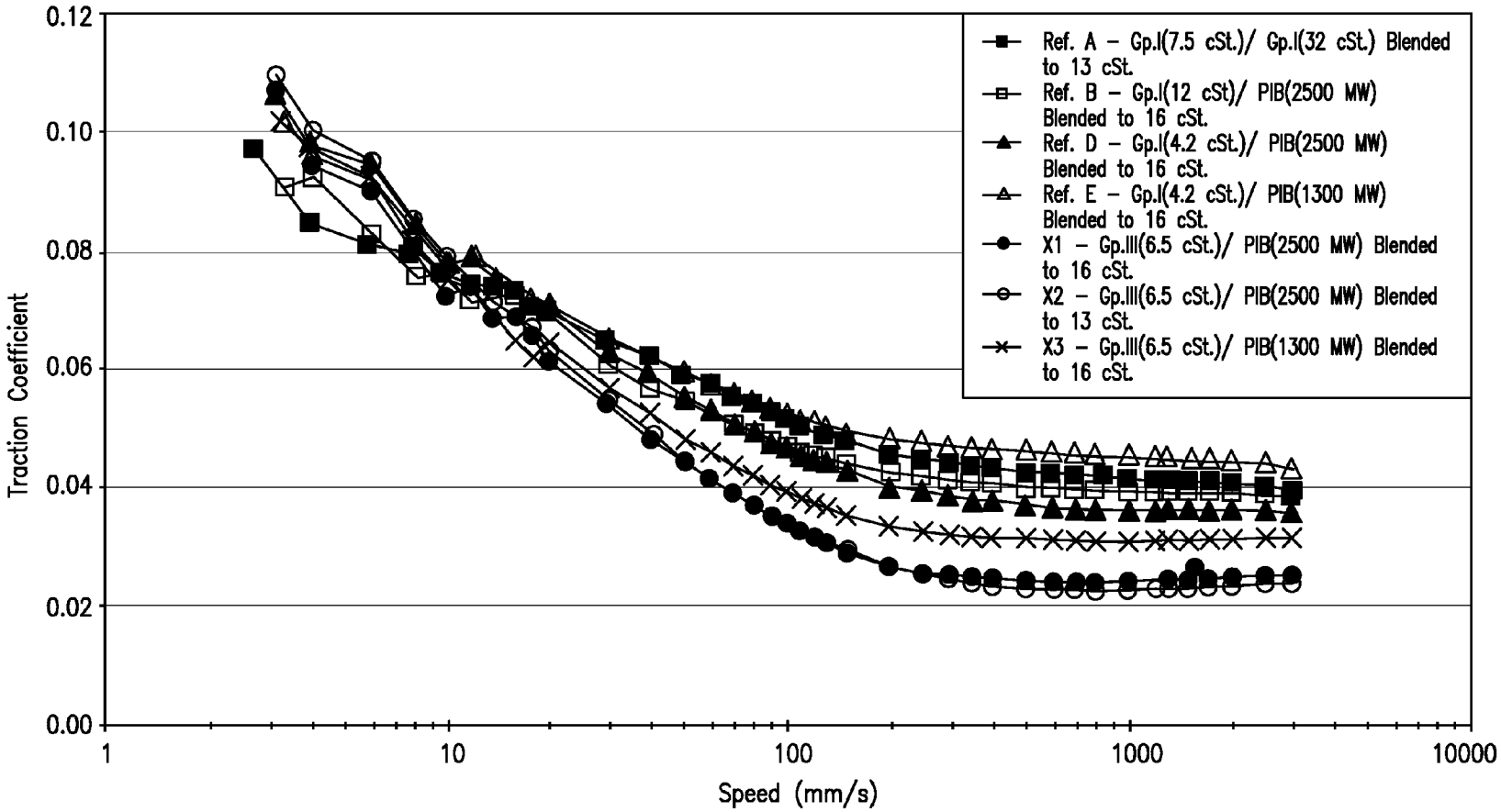
FIG. 1 compares the effect bimodal blends of Group III base stock plus PIB, the blends being blended using PIBs of different molecular weight to different final blend kinematic viscosities have on traction coefficient in the absence of any additives versus reference oils containing blends of Group I base stocks, or blends of Group I base stocks and PIB.

The present invention is directed to a method for improving the fuel economy of large low and medium speed engines by reducing the traction coefficient of the engine oil used to lubricate the engine in which the interfacing surface speeds reach about 3 mm/s and higher, preferably about 10 mm/s and higher, more preferably about 50 mm/s and higher. This is achieved by using as the engine oil to lubricate the engine an engine oil comprising a lubricating oil having a kinematic viscosity at 100° C. of 8 to 25 $mm^2/s$ comprising a base oil comprising a bimodal blend of two different base oils, the first base oil being one or more oils selected from Group III base oils and Group IV base oils, which first base oil has a kinematic viscosity at 100° C. of from 2 to 12 $mm^2/s$ and a second base oil selected from one or more polyisobutylenes (PIBs) having a number average molecular weight of at least 800 Mn, preferably about 800 Mn to 6,000 Mn, more preferably about 1,300 Mn to 4,200 Mn, more preferably about 1,300 Mn to 3,000 Mn, wherein the improvement in the fuel economy is evidenced by the traction coefficient of the engine oil employing the bimodal blend being lower than the traction coefficient of engine oils which are not bimodal or which are based on one or more Group I, or a mixture of Group I base stocks and PIB.

The lubricating oil comprising the combination of the first and second base stocks preferably has a kinematic viscosity of 8 to 25 $mm^2/s$ at 100° C., more preferably a kinematic viscosity at 100° C. of 12 to 21 $mm^2/s$.

In a preferred embodiment the invention is directed to a method for improving the fuel economy of large low and medium speed engine oils by reducing the traction coefficient of the engine oil comprising a base oil operating in an engine that reaches surface speeds of about 3 mm/s and higher, preferably about 10 mm/s and higher, more preferably about 30 mm/s and higher, still more preferably about 100 mm/s and higher, by using as the engine oil to lubricate the engine an engine oil comprising a lubricating oil having a kinematic viscosity at 100° C. in the range of 8 to 25 $mm^2/s$, preferably in the range 8 to 22 $mm^2/s$, more preferably in the range 12 to 21 $mm^2/s$, comprising a base oil comprising a bimodal blend of two different base oils, the first base oil being one or more oils selected from the group consisting of Group III base oils and Group IV base oils having a kinematic viscosity at 100° C. of from 2 to 12 $mm^2/s$ and a second base oil selected from one or more polyisobutylenes (PIB) having a number average molecular weight of at least 800 Mn, preferably about 800 to 6,000 Mn, more preferably about 1,300 to 4,200 Mn, still more preferably about 1,300 to 3,000 Mn, and containing alkali or alkaline earth metal, preferably alkaline earth metal, more preferably calcium, detergent selected from salicylate, sulfonate, carboxylate, phenate, preferably a mixture of phenate and salicylate or a mixture of phenate and carboxylate wherein the improvement in the fuel economy is evidenced by the traction coefficient of the engine oil being lower than the traction coefficient of engine oils which are not bimodal or which are based only on Group I stocks or on a mixture of Group I and PIB base stocks even when containing detergents.

In another embodiment the invention is directed to a method for improving the fuel economy of large low and medium speed engines that reach surface speeds of at least about 60 mm/s and higher, preferably at least about 70 mm/s and higher, by reducing the traction coefficient of the engine oil used to lubricate the engine by using as the engine oil to lubricate the engine an engine oil comprising a lubricating oil having a kinematic viscosity at 100° C. in the range 8 to 25 $mm^2/s$, preferably 8 to 22 $mm^2/s$, more preferably 12 to 25 $mm^2/s$, a bimodal blend of two different base oils, the first base oil being one or more oils selected from Group II base oils, Group III base oils and Group IV base oils, which first base oil has a kinematic viscosity at 100° C. of from 2 to 12 $mm^2/s$ and a second base oil selected from one or more polyisobutylenes (PIBs) having a number average molecular weight of at least 800 Mn, preferably about 800 to 1,600 Mn, more preferably about 1,300 to 4,200 Mn, still more preferably about 1,300 to 3,000 Mn, and optionally and preferably also containing one or more alkali and/or alkaline earth metal, preferably alkaline earth metal, more preferably calcium, detergent selected from salicylate, sulfonate, carboxylate, phenate, preferably a mixture of phenate and salicylate or a mixture of phenate and carboxylate, more preferably phenate and salicylate, wherein the improvement in the fuel economy is evidenced by the traction coefficient of the engine oil being lower than the traction coefficient of engine oils which are not bimodal or which are based solely on Group I base oils or on mixtures of Group I base oils and PIB.

In another embodiment the invention is directed to a method for improving the fuel economy of large low and medium speed engines that reach surface speeds of at least 3 mm/s, preferably of at least 10 mm/s, more preferably at least 60 mm/s, and are lubricated by an engine oil by reducing the traction coefficient of the engine oil used to lubricate the engine, by employing as the engine oil a lubricating oil having a kinematic viscosity at 100° C. of 8 to 25 $mm^2/s$, comprising a first base oil selected from the group consisting of a Group III base oil and Group IV base oil having a kinematic viscosity at 100° C. of 2 to 12 $mm^2/s$ and a second base oil selected from polyisobutylenes (PIBs) having a number average molecular weight of at least 800 Mn, preferably about 800 Mn to 6,000 Mn, more preferably about 1,300 Mn to 4,200 Mn, or preferably about 1,300 Mn to 3,000 Mn, wherein the improvement in fuel economy is evidenced by the engine oil having a traction coefficient which is lower than the traction coefficient of an engine oil of the same kinematic viscosity at 100° C. comprising a single base oil component of a Group III base oil or Group IV base oil or which are based on one or more Group I base oils or on a mixture of Group I base oils and PIB.

As employed herein and in the appended claims, the terms "base stock" and "base oil" are used synonymously and interchangeably.

By "surface speed" is meant the velocity at which two interfacing surfaces, such as cylinder wall and piston, or bearing surfaces move past each one another during the operation of the engine. This surface speed is a primary factor in influencing whether the lubrication regime for the interfacing surfaces is boundary, hydrodynamic or mixed (boundary/hydrodynamic).

The method of the present invention utilizes a bimodal mixture of base stocks. By bimodal in the present specification is meant a mixture of at least two base stocks each having a different kinematic viscosity at 100° C. wherein the difference in kinematic viscosity at 100° C. between the at least two base stocks is at least the difference between the low viscosity base stock and polyisobutylenes (PIBs) which have a number average molecular weight of at least 800 Mn. The mixture of the at least two base stocks comprises one or more low kinematic viscosity base stock(s) having a kinematic viscosity at 100° C. of from 2 to 12 cSt ($mm^2/s$), which base stock is selected from the group consisting of Group II, Group III and Group IV base stocks, using the API classification, in combination with one or more polyisobutylenes (PIBs), which have a number average molecular weight of at least 800 Mn. The degree of bimodality of these combinations can be determined by measuring the kinematic viscosity of the PIBs at 100° C. in accordance with ASTM D445. For example, the kinematic viscosity of PIB (1300 MW) at 100° C. is approximately 630 $mm^2/s$, and the kinematic viscosity of PIB (2500 MW) at 100° C. is approximately 4,100 $mm^2/s$.

Group III base stocks are classified by the American Petroleum Institute as oils containing greater than or equal to 90% saturates, less than or equal to 0.03% sulfur and a viscosity index of greater than or equal to 120. Group III base stocks are usually produced using a three-stage process involving hydrocracking an oil feed stock, such as vacuum gas oil, to remove impurities and to saturate all aromatics which might be present to produce highly paraffinic lube oil stock of very high viscosity index, subjecting the hydrocracked stock to selective catalytic hydrodewaxing which converts normal paraffins into branched paraffins by isomerization followed by hydrofinishing to remove any residual aromatics, sulfur, nitrogen or oxygenates.

Group III stocks also embrace non-conventional or unconventional base stocks and/or base oils which include one or a mixture of base stock(s) and/or base oil(s) derived from: (1) one or more Gas-to-Liquids (GTL) materials; as well as (2) hydrodewaxed, or hydroisomerized/cat (and/or solvent) dewaxed base stock(s) and/or base oil(s) derived from synthetic wax, natural wax or waxy feeds, waxy feeds including mineral and/or non-mineral oil waxy feed stocks such as gas oils, slack waxes (derived from the solvent dewaxing of natural oils, mineral oils or synthetic; e.g., Fischer-Tropsch feed stocks) and waxy stocks such as waxy fuels hydrocracker bottoms, waxy raffinate, hydrocrackate, thermal crackates, foots oil or other mineral, mineral oil, or even non-petroleum oil derived waxy materials such as waxy materials recovered from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (and/or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions combined with one, two or more higher viscosity fractions to produce a blend wherein the blend exhibits a target kinematic viscosity in the range of 2 to 12 $mm^2/s$ at 100° C.

The GTL material, from which the GTL base stock(s) and/or base oil(s) is/are derived is preferably an F-T material (i.e., hydrocarbons, waxy hydrocarbons, wax).

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

Useful compositions of GTL base stock(s) and/or base oil(s), hydrodewaxed or hydroisomerized/cat (and/or solvent) dewaxed F-T material derived base stock(s), and wax-derived hydrodewaxed, or hydroisomerized/cat (and/or solvent) dewaxed base stock(s), such as wax isomerates or hydrodewaxates, are recited in U.S. Pat. Nos. 6,080,301; 6,090,989, and 6,165,949, for example.

Base stock(s) and/or base oil(s) derived from waxy feeds, which are also suitable for use as the Group III stocks in this invention, are paraffinic fluids of lubricating viscosity derived from hydrodewaxed, or hydroisomerized/cat (and/or solvent) dewaxed waxy feed stocks of mineral oil, non-mineral oil, non-petroleum, or natural source origin, e.g. feed stocks such as one or more of gas oils, slack wax, waxy fuels hydrocracker bottoms, hydrocarbon raffinates, natural waxes, hydrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stock(s) and/or base oil(s).

Slack wax is the wax recovered from any waxy hydrocarbon oil including synthetic oil such as F-T waxy oil or petroleum oils by solvent or auto-refrigerative dewaxing. Solvent dewaxing employs chilled solvent such as methyl ethyl ketone (MEK), methyl isobutyl ketone (MIBK), mixtures of MEK/MIBK, mixtures of MEK and toluene, while auto-refrigerative dewaxing employs pressurized, liquefied low boiling hydrocarbons such as propane or butane.

Slack waxes secured from synthetic waxy oils such as F-T waxy oil will usually have zero or nil sulfur and/or nitrogen containing compound content. Slack wax(es) secured from petroleum oils, may contain sulfur and nitrogen-containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The process of making the lubricant oil base stocks from waxy stocks, e.g. slack wax, F-T wax or waxy feed, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst.

Following any needed hydrodenitrogenation or hydrosulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, Offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feed stock may be conducted over a combination of Pt/zeolite beta and Pt/ZSM-23 catalysts or over such catalysts used in series in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over a catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269.

A dewaxing step, when needed, may be accomplished using one or more of solvent dewaxing, catalytic dewaxing or hydrodewaxing processes or combinations of such processes in any sequence.

In solvent dewaxing, the hydroisomerate may be contacted with chilled solvents such as acetone, methyl ethyl ketone (MEK), methyl isobutyl ketone (MIBK), mixtures of ME/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Auto-refrigerative dewaxing using low molecular weight hydrocarbons, such as propane, can also be used in which the hydroisomerate is mixed with, e.g., liquid propane, at least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention.

In catalytic dewaxing the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials which are separated from the heavier base stock fraction. This base stock fraction can then be fractionated into two or more base stocks. Separation of the lower boiling material may be accomplished either prior to or during fractionation of the heavy base stock fraction material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPOs. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400 to 600° F., a pressure of 500 to 900 psig, $H_2$ treat rate of 1500 to 3500 SCF/B for flow-through reactors and LHSV of 0.1 to 10, preferably 0.2 to 2.0. The dewaxing is typically conducted to convert no more than 40 wt % and preferably no more than 30 wt % of the hydroisomerate having an initial boiling point in the range of 650 to 750° F. to material boiling below its initial boiling point.

The first base stock of the bimodal mixture can also be a Group IV base stock which for the purposes of this specification and the appended claims is identified as polyalpha olefins.

The polyalpha olefins (PAOs) in general are typically comprised of relatively low molecular weight hydrogenated polymers or oligomers of polyalphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins.

The PAO fluids may be conveniently made by the polymerization of an alphaolefin in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl proprionate. For example, the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The PAOs useful in the present invention can also be made by metallocene catalysis. The metallocene-catalyzed PAO (mPAO) can be a copolymer made from at least two alphaolefins or more, or a homo-polymer made from a single alphaolefin feed by a metallocene catalyst system.

The metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion. mPAO and methods for producing mPAO employing metallocene catalysis are described in WO 2009/123800, WO 2007/011832 and U.S. Published Application U.S. 2009/0036725.

The copolymer mPAO composition is made from at least two alphaolefins of $C_3$ to $C_{30}$ range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers of the invention can be isotactic, atactic, syndiotactic polymers or any other form of appropriate taciticity.

mPAO is also made from mixed feed Linear Alpha Olefins (LAOS) comprising at least two and up to 26 different linear alphaolefins selected from $C_3$ to $C_{30}$ linear alphaolefins. In a preferred embodiment, the mixed feed LAO is obtained from an ethylene growth processing using an aluminum catalyst or a metallocene catalyst. The growth olefins comprise mostly $C_6$ to $C_{18}$ LAO. LAOs from other processes can also be used.

The homo-polymer mPAO composition is made from single alphaolefin choosing from $C_3$ to $C_{30}$ range, preferably $C_3$ to $C_{16}$, most preferably $C_3$ to $C_{14}$ or $C_3$ to $C_{12}$. The homo-polymers can be isotactic, atactic, syndiotactic polymers or any other form of appropriate taciticity. The taciticity can be carefully tailored by the polymerization catalyst and polymerization reaction condition chosen or by the hydrogenation condition chosen.

The alphaolefin(s) can be chosen from any component from a conventional LAO production facility or from a refinery. It can be used alone to make homo-polymer or together with another LAO available from a refinery or chemical plant, including propylene, 1-butene, 1-pentene, and the like, or with 1-hexene or 1-octene made from a dedicated production facility. The alphaolefins can be chosen from the alphaolefins produced from Fischer-Tropsch synthesis (as reported in U.S. Pat. No. 5,382,739). For example, $C_3$ to $C_{16}$ alphaolefins, more preferably linear alphaolefins, are suitable to make homo-polymers. Other combinations, such as $C_4$- and $C_{14}$-LAO, $C_6$- and $C_{16}$-LAO, $C_8$-, $C_{10}$-, $C_{12}$-LAO, or $C_8$- and $C_{14}$-LAO, $C_6$-, $C_{10}$-, $C_{14}$-LAO, $C_4$- and $C_{12}$-LAO, etc., are suitable to make copolymers.

A feed comprising a mixture of LAOs selected from $C_3$ to $C_{30}$ LAOs or a single LAO selected from $C_3$ to $C_{16}$ LAO, is contacted with an activated metallocene catalyst under oligomerization conditions to provide a liquid product suitable for use in lubricant components or as functional fluids. Also embraced are copolymer compositions made from at least two alphaolefins of $C_3$ to $C_{30}$ range and having monomers randomly distributed in the polymers. The phrase "at least two alphaolefins" will be understood to mean "at least two different alphaolefins" (and similarly "at least three alphaolefins" means "at least three different alphaolefins", and so forth).

The product obtained is an essentially random liquid copolymer comprising the at least two alphaolefins. By "essentially random" is meant that one of ordinary skill in the art would consider the products to be random copolymer. Likewise the term "liquid" will be understood by one of ordinary skill in the art as meaning liquid under ordinary conditions of temperature and pressure, such as ambient temperature and pressure.

The process employs a catalyst system comprising a metallocene compound (Formula 1, below) together with an activator such as a non-coordinating anion (NCA) (Formula 2, below) or methylaluminoxane (MAO) 1111 (Formula 3, below):

Formula 1

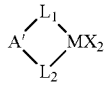

Formula 2

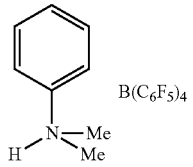

NCA

Formula 3

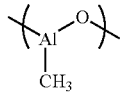

MAO

The term "catalyst system" is defined herein to mean a catalyst precursor/activator pair, such as a metallocene/activator pair. When "catalyst system" is used to describe such a pair before activation, it means the unactivated catalyst (precatalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkyl aluminum compound, is also used as an impurity scavenger.

The metallocene is selected from one or more compounds according to Formula 1 above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated. A is an optional bridging group which, if present, in preferred embodiments is selected from dialkylsilyl, dialkylmethyl, diphenylsilyl or diphenylmethyl, ethylenyl ($—CH_2—CH_2$), alkylethylenyl ($—CR_2—CR_2$), where alkyl can be independently $C_1$ to $C_{16}$ alkyl radical or phenyl, tolyl, xylyl radical and the like, and wherein each of the two X groups, Xa and Xb, are independently selected from halides OR (R is an alkyl group, preferably selected from $C_1$ to $C_5$ straight or branched chain alkyl groups), hydrogen, $C_1$ to $C_{16}$ alkyl or aryl groups, haloalkyl, and the like. Usually relatively more highly substituted metallocenes give higher catalyst productivity and wider product viscosity ranges and are thus often more preferred.

The polyalphaolefins preferably have a Bromine number of 1.8 or less as measured by ASTM D1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

The m-polyalphaolefins described herein may have monomer units represented by Formula 4 in addition to the all regular 1,2-connection:

Formula 4

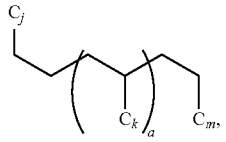

where j, k and m are each, independently, 3, 4, 5, 6, 7, 8, 9, 10, 11, 12, 13, 14, 15, 16, 17, 18, 19, 20, 21 or 22, n is an integer from 1 to 350 (preferably 1 to 300, preferably 5 to 50) as measured by proton NMR.

Any of the m-polyalphaolefins (mPAO) described herein preferably have an Mw (weight average molecular weight) of 100,000 or less, preferably between 100 and 80,000, preferably between 250 and 60,000, preferably between 280 and 50,000, preferably between 336 and 40,000 g/mol.

Any of the m-polyalphaolefins (mPAO) described herein preferably have a Mn (number average molecular weight) of 50,000 or less, preferably between 200 and 40,000, preferably between 250 and 30,000, preferably between 500 and 20,000 g/mol.

Any of the m-polyalphaolefins (mPAO) described herein preferably have a molecular weight distribution (MWD-Mw/Mn) of greater than 1 and less than 5, preferably less than 4, preferably less than 3, preferably less than 2.5. The MWD of mPAO is always a function of fluid viscosity. Alternately, any of the polyalphaolefins described herein preferably have an Mw/Mn of between 1 and 2.5, alternately between 1 and 3.5, depending on fluid viscosity.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 ml/min, and a sample concentration of 1 wt %, and the Column Set is a Phenogel 500 A, Linear, 10E6A.

Any of the m-polyalphaolefins (mPAO) described herein may have a substantially minor portion of a high end tail of the molecular weight distribution. Preferably, the mPAO has not more than 5.0 wt % of polymer having a molecular weight of greater than 45,000 Daltons. Additionally or alternatively, the amount of the mPAO that has a molecular weight greater than 45,000 Daltons is not more than 1.5 wt %, or not more than 0.10 wt %. Additionally or alternatively, the amount of the mPAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

Any PAO described herein may have a pour point of less than 0° C. (as measured by ASTM D97), preferably less than −10° C., preferably less than 20° C., preferably less than −25° C., preferably less than −30° C., preferably less than −35° C., preferably less than −50° C., preferably between −10° C. and −80° C., preferably between −15° C. and −70° C.

Polyalphaolefins made using metallocene catalysis may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 8 cSt to about 500 cSt as measured by ASTM D445.

PAOs useful in the present invention include those made by the process disclosed in U.S. Pat. No. 4,827,064 and U.S. Pat. No. 4,827,073. Those PAO materials, which are produced by the use of a reduced valence state chromium catalyst, are olefin oligomers of polymers which are characterized by very high viscosity indices which give them very desirable properties to be useful as lubricant base stocks and, with higher viscosity grades, as VI improvers. They are referred to as High Viscosity Index PAOs or HVI-PAOs.

Various modifications and variations of these HVI-PAO materials are also described in the following U.S. Patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. No. 5,012,020 and U.S. Pat. No. 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: $C_{30}$ to $C_{1300}$ hydrocarbons having a branch ratio of less than 0.19, a weight average molecular weight of between 300 and 45,000, a number average molecular weight of between 300 and 18,000, a molecular weight distribution of between 1 and 5. HVI-PAOs are fluids with 100° C. viscosity ranging from 5 to 5000 $mm^2/s$ or more. Furthermore, the fluids with viscosity at 100° C. of 3 $mm^2/s$ to 5000 $mm^2/s$ have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of $C_6$ to $C_{20}$ 1-alkenes. Examples of the feeds can be 1-hexene, 1-octene, 1-decene, 1-dodecene, 1-tetradecene, etc. or mixture of $C_6$ to $C_{14}$ 1-alkenes or mixture of $C_6$ to $C_{20}$ 1-alkenes, $C_6$ and $C_{12}$ 1-alkenes, $C_6$ and $C_{14}$ 1-alkenes, $C_6$ and $C_{16}$ 1-alkenes, $C_6$ and $C_{18}$ 1-alkenes, $C_8$ and $C_{10}$ 1-alkenes, $C_8$ and $C_{12}$ 1-alkenes, $C_8$, $C_{10}$ and $C_{12}$ 1-alkenes, and other appropriate combinations.

The products usually are distilled to remove any low molecular weight compositions such as those boiling below 600° F., or with carbon numbers less than $C_{20}$, if they are produced from the polymerization reaction or are carried over from the starting material. This distillation step usually improves the volatility of the finished fluids.

The fluids made directly from the polymerization or oligomerization process usually have unsaturated double bonds or have olefinic molecular structure. The amount of double bonds or unsaturation or olefinic components can be measured by several methods, such as bromine number (ASTM D1159), bromine index (ASTM D2710) or other suitable analytical methods, such as NMR, IR, etc. The amount of the double bond or the amount of olefinic compositions depends on several factors—the degree of polymerization, the amount of hydrogen present during the polymerization process and the amount of other promoters which anticipate in the termination steps of the polymerization process, or other agents present in the process. Usually the amount of double bonds or the amount of olefinic components is decreased by the higher degree of polymerization, the higher amount of hydrogen gas present in the polymerization process or the higher amount of promoters participating in the termination steps.

It is known that, usually, the oxidative stability and light or UV stability of fluids improves when the amount of unsaturation double bonds or olefinic contents is reduced. Therefore, it is desirable to hydrotreat the polymer if it has a high degree of unsaturation. Usually the fluids with bromine number of less than 5, as measured by ASTM D1159, are suitable for high quality base stock application. Of course, the lower the bromine number, the better the lube quality. Fluids with bromine numbers of less than 3 or 2 are common. The most preferred range is less than 1 or less than 0.1. The method to hydrotreat to reduce the degree of unsaturation is well known in literature (U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, it can be used use as is without hydrotreating, or it can be hydrotreated to further improve the base stock properties.

Regardless of their origin or the processes or techniques used for their production, the first low kinematic viscosity fluid can be employed as an oil from a single source or as a mixture of oils, provided the single oil or mixture of oils has a low kinematic viscosity in the range of 2 to 12 $mm^2/s$ at 100° C.

Thus, the low kinematic viscosity fluid can constitute a single base stock meeting the recited kinematic viscosity or it can be made up of two or more base stocks, each individually meeting the recited kinematic viscosity limits. Further, the low kinematic viscosity fluid can be made up of mixtures of one, two or more low viscosity stocks, e.g. stocks with kinematic viscosities in the range of 2 to 12 $mm^2/s$ at 100° C. combined with one, two or more higher kinematic viscosity stocks, e.g. stocks with kinematic viscosities greater than 12 $mm^2/s$ at 100° C., such as stocks with kinematic viscosities of 100 $mm^2/s$ or greater at 100° C., provided that the resulting mixture blend exhibits the target low kinematic viscosity of 2 to 12 $mm^2/s$ at 100° C. recited as the viscosity range of the first low kinematic viscosity fluid.

The second oil used in the bimodal blend is a high kinematic viscosity polyisobutylene (PIB) having a number average molecular weight of at least 800 Mn, preferably 800 to 6,000 Mn, more preferably 1,300 to 4,200 Mn, still more preferably 1,300 to 3,000 Mn.

The present invention achieves its improvement in fuel economy as evidenced by a reduction in traction coefficient by use of a lubricant comprising a bimodal blend of two different base oils, the first being one or more Group II or Group III base oils having a KV at 100° C. of from 2 to 12 $mm^2/s$ and the second being one or more polyisobutylenes (PIBs) having a number average molecular weight of at least 800 Mn. When using such a bimodal blend of base stocks, the traction coefficient of the oil being used at surface speeds as low as 10 mm/s is reduced as compared to using engine oils which are not bimodal or which are based only on Group I base stocks or Group I base stocks plus PIB, and even when containing detergents.

The traction coefficient can be reduced at even lower surface speeds, surface speeds as low as 3 mm/s by using the above recited bimodal base stock blend in combination with an alkali or alkaline earth metal, preferably alkaline earth, most preferably calcium, detergent, selected from the group consisting of salicylate, phenate, sulfonate or carboxylate, preferably phenate and salicylate detergents or phenate and carboxylate detergents. The detergents need not be the salt of a single metal but can be a mixture of metal salts, e.g. a mixture of sodium salt and/or lithium salt and/or calcium salt and/or magnesium salt, only by way of example and not limitation.

The method for reducing traction coefficient uses engine lubricating oil composition as described above containing the bimodal base stock blend as a minimum necessary and essential component. Preferably the engine lubricating oil used to achieve the reduction in traction coefficient comprises as essential components both the bimodal base stock blend and the detergent.

The method can use engine lubricating oils containing additional performance additives provided the base stock comprises the essential bimodal blend base stock and preferably the bimodal blend base stock and the detergent, preferably a mixture of metal phenate and metal salicylate detergents or phenate/carboxylate detergents. When the detergent(s) are employed in the bimodal blend it/they is/are present in a total amount in the range of 4 to 33 wt %, preferably 8 to 25 wt %, more preferably 8 to 20 wt %, of the lubricant (based on detergent active ingredient).

The detergent(s) used can be of a Total Base Number (TBN) ranging from neutral/low to high, e.g. 0-40 to 400 or more. The finished lubricating oil will have a TBN of at least 5, preferably 40 to 100 mg KOH/g, more preferably 40 to 70 mg KOH/g.

When a mixture of phenate and salicylate or a mixture of phenate and carboxylate detergents is employed, the weight ratio of phenate detergent to salicylate or carboxylate detergent can be in the range 95:5 to 5:95, preferably 3:1 to 1:3.

The formulated lubricating oil useful in the present invention may additionally contain one or more of the other commonly used lubricating oil performance additives including but not limited to dispersants, other detergents, corrosion inhibitors, anti-oxidants, rust inhibitors, metal deactivators, anti-wear and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant invention in lubricant compositions are not limited by the examples shown herein as illustrations.

Viscosity Improvers

Viscosity improvers (also known as Viscosity Index modifiers, and VI improvers) provide lubricants with high and low temperature operability. These additives increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity improvers are polymers and copolymers of methacrylate, butadiene, olefins, or alkylated styrenes. Suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 12 wt %, preferably zero to 6 wt %, more preferably zero to 4 wt % based on active ingredient and depending on the specific viscosity modifier used.

Antioxidants

Typical anti-oxidant include phenolic anti-oxidants, aminic anti-oxidants and oil-soluble copper complexes.

The phenolic anti-oxidants include sulfurized and non-sulfurized phenolic anti-oxidants. The terms "phenolic type" or "phenolic anti-oxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from about 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

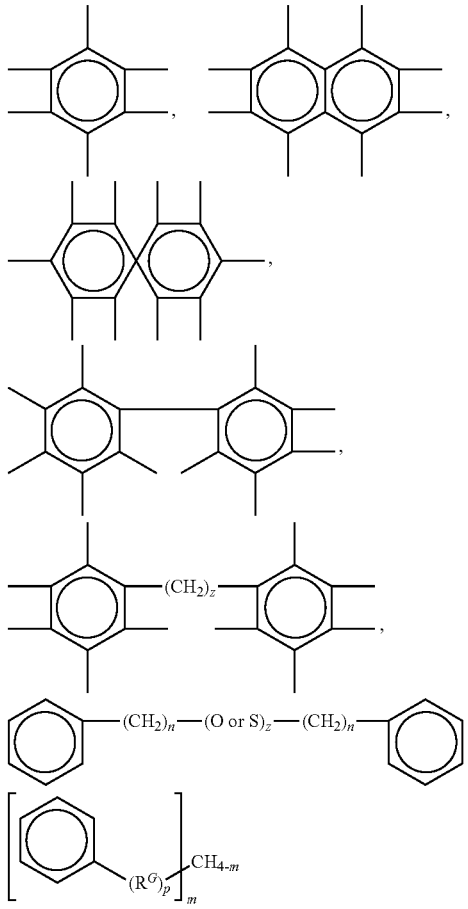

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic anti-oxidant compounds are the hindered phenolics which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol.

Phenolic type anti-oxidants are well known in the lubricating industry and commercial examples such as Ethanox®

4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

Aromatic amine anti-oxidants include phenyl-α-naphthyl amine which is described by the following molecular structure:

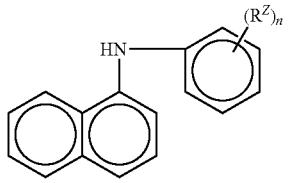

wherein $R^Z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines anti-oxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of such other additional amine anti-oxidants which may be present include diphenylamines, phenothiazines, imidodibenzyls and diphenyl phenylene diamines. Mixtures of two or more of such other additional aromatic amines may also be present. Polymeric amine anti-oxidants can also be used.

Another class of anti-oxidant used in lubricating oil compositions and which may be present in addition to the necessary phenyl-α-naphthylamine is oil-soluble copper compounds. Any oil-soluble suitable copper compound may be blended into the lubricating oil. Examples of suitable copper anti-oxidants include copper dihydrocarbyl thio- or dithiophosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Such anti-oxidants may be used in an amount of about 0.50 to 5 wt %, preferably about 0.75 to 3 wt % (on an as-received basis).

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %, more preferably about 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers.

Such additives may be used in amount of about 0.0 to 0.5 wt %, preferably about 0 to 0.3 wt %, more preferably about 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof.

Such additives may be used in an amount of about 0.01 to 5 wt %, preferably about 0.01 to 1.5 wt %, more preferably about 0.01 to 0.2 wt %, still more preferably about 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt % on an as-received basis.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent, preferably 0.001 to about 0.5 wt %, more preferably about 0.001 to about 0.2 wt %, still more preferably about 0.0001 to 0.15 wt % (on an as-received basis) based on the total weight of the lubricating oil composition.

Inhibitors and Anti-Rust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt % on an as-received basis.

Anti-wear additives can also advantageously be present. Anti-wear additives are exemplified by metal dithiophosphate, metal dithiocarbamate, metal dialkyl dithiophosphate, metal xanthage where the metal can be zinc or molybdenum. Tricresylphosphates are another type of anti-wear additive. Such anti-wear additives can be present in an amount of about 0.05 to 1.5 wt %, preferably about 0.1 to 1.0 wt %, more preferably about 0.2 to 0.5 wt % on an as-received basis.

COMPARATIVE EXAMPLES AND EXAMPLES

A series of engine oils was evaluated in regard to the effect base stock composition and detergent type have on traction coefficient. The engine oils were either a commercially available oil or unadditized base stock or base stock blends or additized base stock or base stock blends.

Figure 2:
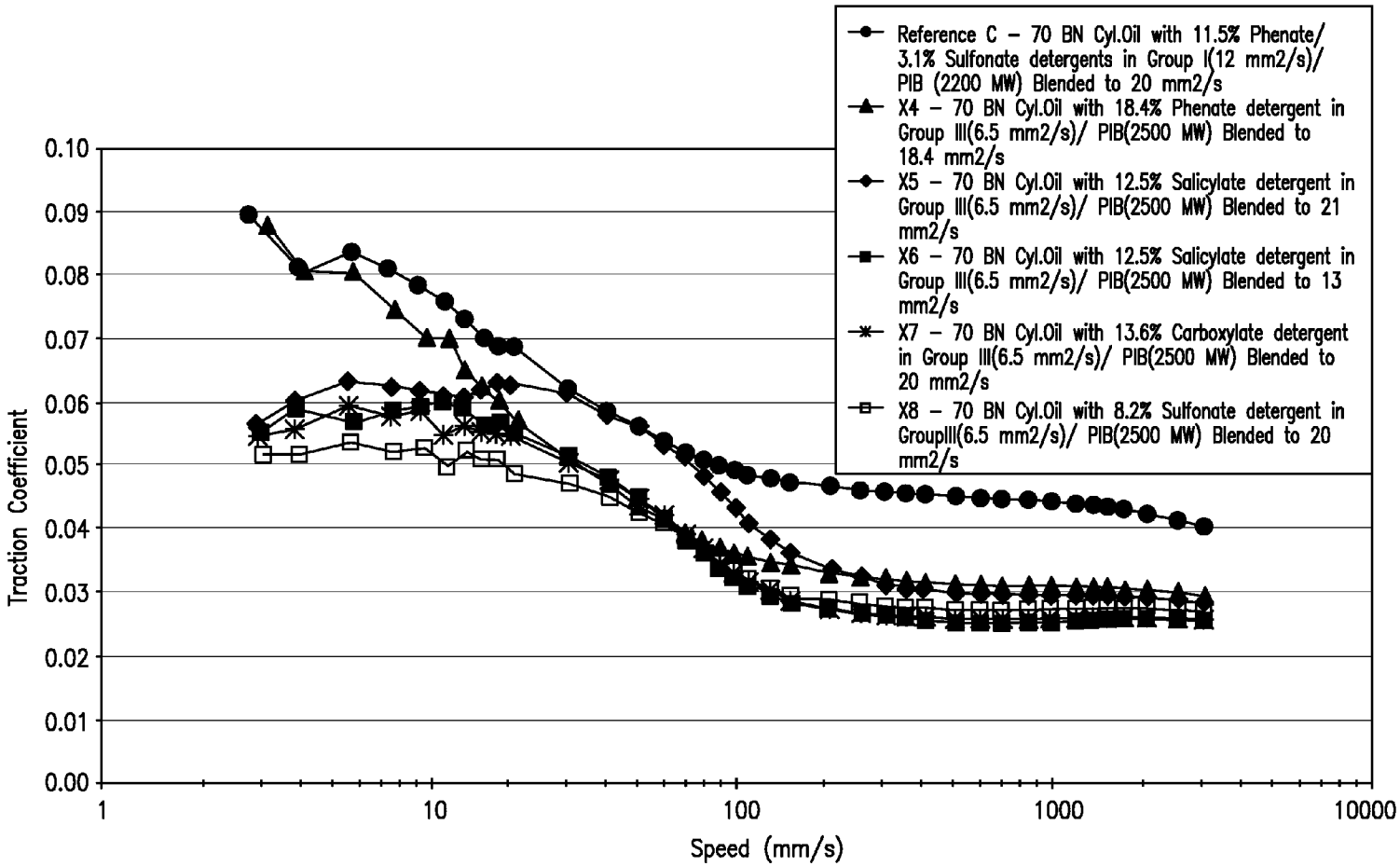
FIG. 2 shows the effect bimodal blends of Group III base stocks plus PIB, the blends being blended to different final blend kinematic viscosities, have on traction coefficient in the presence of different detergents individually versus a reference oil containing a blend of Group I base stock and PIB containing detergents.
Figure 3:
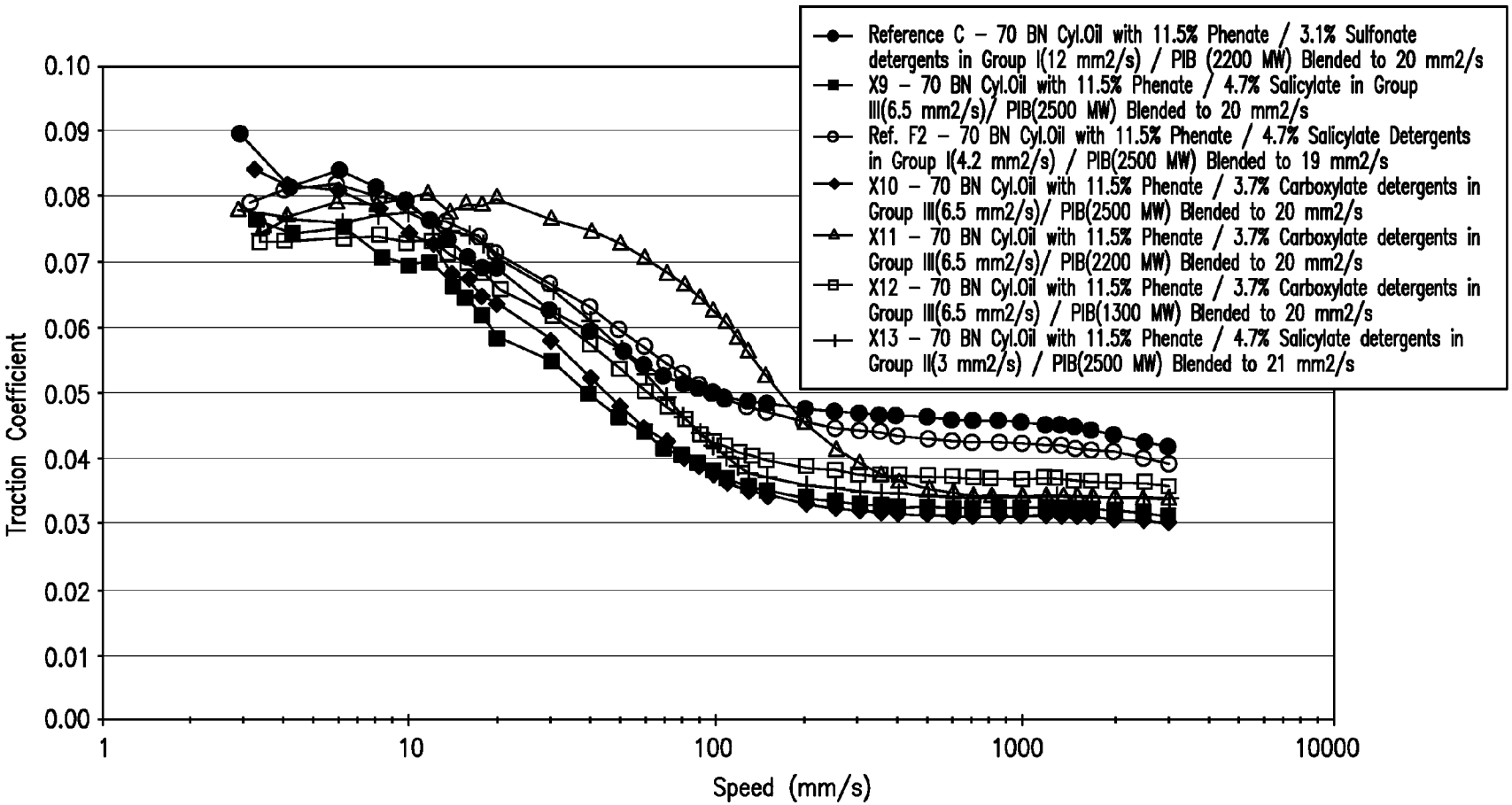
FIG. 3 shows the effect bimodal blends of Group III base stock or Group II base stock plus different molecular weight PIBs, the blends being blended to nominally the same final blend kinematic viscosities have on traction coefficient in the presence of different mixtures of detergents versus reference oils containing blends of Group I base stock and PIB containing detergent.

The traction coefficient was measured employing the MTM Traction Rig which is a fully automated Mini Traction Machine traction measurement instrument. The rig is manufactured by PCS Instruments and is identified as Model MTM. The test specimens and apparatus configuration are specified such that realistic pressures, temperatures and speeds can be attained without requiring very large loads, motors or structures. A small sample of fluid (50 ml) is placed in the test cell and the machine automatically runs through a range of speeds, slide-to-roll ratios, temperatures and loads to produce a comprehensive traction map for the test fluid without operational intervention. The standard test specimens are a polished 19.05 mm ball and a 50.0 mm diameter disc manufactured from AISI 52100 bearing steel. The specimens are designed to be single use, throw away items. The ball is loaded against the face of the disc and the ball and disc are driven independently by DC servo motors and drives to allow high precision speed control, particularly at low slide/roll ratios. Each specimen is end mounted on shafts in a small stainless steel test fluid bath. The vertical shaft and drive system which supports the disk test specimen is fixed. However, the shaft and drive system which supports the ball test specimen is supported by a gimbal arrangement such that it can rotate around two orthogonal axes. One axis is normal to the load application direction, the other to the traction force direction. The ball and disk are driven in the same direction. Application of the load and restraint of the traction force is made through high stiffness force transducers appropriately mounted in the gimbal arrangement to minimize the overall support system deflections. The output from these force transducers is monitored directly by a personal computer. The traction coefficient is the ratio of the traction force to the applied load. As shown in FIGS. 1-3, the traction coefficient was measured over a range of speeds. In FIGS. 1-3, the speed on the x-axis is the entrainment speed, which is half the sum of the ball and disk speeds. These entrainment speeds simulate the range of surface speeds, or at least a portion of the range of surface speeds, reached when the engine is operating.

The test results presented herein were generated under the following test conditions:

| | |
|---|---|
| Temperature | 100° C. |
| Load | 1.0 GPa |
| Slide-to-roll ratio (SRR) | 50% |
| Speed gradient | 0-3000 mm/sec in 480 seconds |

The lubricating oils are described in Table 1:

TABLE 1

| Oil Designation | Detergent System (% Active) (TBN of Full Blend) | Base Stock | Lubricating Oil KV @ 100° C. |
|---|---|---|---|
| Ref. A | None (0) | Group I (7.5 $mm^2/s$)/ Group I (32 $mm^2/s$) | 13 $mm^2/s$ |
| Ref. B | None (0) | Group I (12 $mm^2/s$)/ PIB (2500 MW) | 16 $mm^2/s$ |
| Ref. C | Overbased Calcium Phenate (11.5%), Overbased Ca Sulfonate (3.1%) (70) | Group I (12 $mm^2/s$)/ PIB (2200 MW) | 20 $mm^2/s$ |
| Ref. D | None (0) | Group I (4.2 $mm^2/s$)/ PIB (2500 MW) | 16 $mm^2/s$ |
| Ref. E | None (0) | Group I (4.2 $mm^2/s$)/ PIB (1300 MW) | 16 $mm^2/s$ |
| Ref. F2 | Overbased Ca Phenate (11.5%), Overbased Ca Salicylate (4.7%) (70 BN) | Group I (4.2 $mm^2/s$)/ PIB (2500 MW) | 19 $mm^2/s$ |
| X1 | None (0) | Group III (6.5 $mm^2/s$)/ PIB (2500 MW) | 16 $mm^2/s$ |
| X2 | None (0) | Group III (6.5 $mm^2/s$)/ PIB (2500 MW) | 13 $mm^2/s$ |
| X3 | None (0) | Group III (6.5 $mm^2/s$)/ PIB (1300 MW) | 16 $mm^2/s$ |
| X4 | Overbased Ca Phenate (18.4%) (70) | Group III (6.5 $mm^2/s$)/ PIB (2500 MW) | 18.4 $mm^2/s$ |
| X5 | Overbased Ca Salicylate (12.5%) (70) | Group III (6.5 $mm^2/s$)/ PIB (2500 MW) | 21 $mm^2/s$ |
| X6 | Overbased Ca Salicylate (12.5%) (70) | Group III (6.5 $mm^2/s$)/ PIB (2500 MW) | 13 $mm^2/s$ |
| X7 | Overbased Ca Sulfonates (8.2%) (70) | Group III (6.5 $mm^2/s$)/ PIB (2500 MW) | 20 $mm^2/s$ |
| X8 | Overbased Ca Sulfonate (8.2%) (70) | Group III (6.5 $mm^2/s$)/ PIB (2500 MW) | 20 $mm^2/s$ |
| X9 | Overbased Ca Phenate (11.5%)/ Overbased Ca Salicylate (4.7%) (70 BN) | Group III (6.5 $mm^2/s$)/ PIB (2500 MW) | 20 $mm^2/s$ |
| X10 | Overbased Ca Phenate (11.5%)/ Overbased Ca Carboxylate (3.7%) (70 BN) | Group III (6.5 $mm^2/s$)/ PIB (2200 MW) | 20 $mm^2/s$ |
| X11 | Overbased Ca Phenate (11.5%)/ Overbased Ca Carboxylate (3.7%) (70 BN) | Group III (6.5 $mm^2/s$)/ PIB (2200 MW) | 20 $mm^2/s$ |
| X12 | Overbased Ca Phenate (11.5%)/ Overbased Ca Carboxylate (3.7%) (70 BN) | Group III (6.5 $mm^2/s$)/ PIB (1300 MW) | 20 $mm^2/s$ |

TABLE 1-continued

| Oil Designation | Detergent System (% Active) (TBN of Full Blend) | Base Stock | Lubricating Oil KV @ 100° C. |
|---|---|---|---|
| X13 | Overbased Ca Phenate (11.5%)/ Overbased Ca Salicylate (4.7%) (70 BN) | Group II (3 $mm^2/s$)/ PIB (2500 MW) | 21 $mm^2/s$ |

Referring to FIG. 1, it is seen that the blend of a Group I oil and PIB (Reference Oils B, D and E) showed no significant benefit relative to the Group I/Group I base oil blend (Reference Oil A).

The blend of Group III oil and PIB (Oils X1, X2 and X3 showed a significant benefit over the Group I/Group I and Group I/PIB blends in the moderate-to-high speed regions (20 mm/s and higher, becoming more apparent at 30 mm/s and higher).

The blends containing the higher molecular weight PIB (2500 MW versus 1300 MW (Oil X1 versus Oil X3)) exhibited greater reduction in traction coefficient when blended with Group III stock to the same blend kinematic viscosity (about 16 $mm^2/s$).

For blends containing PIB of the same molecular weight and Group III oils of the same kinematic viscosity (Oil X1 and Oil X2), there is no difference in the benefit when the kinematic viscosity is 13 $mm^2/s$ versus 16 $mm^2/s$.

Referring to FIG. 2, it is seen that blends of 70 TBN cylinder oil detergent systems comprised of 100% overbased calcium salicylate (Oil X6), 100% overbased calcium carboxylate (Oil X7) or 100% overbased calcium sulfonate (Oil X8) in Group III/PIB mixed base stock all provide a large benefit over the entire speed range versus Reference Oil C (overbased calcium phenate/overbased calcium sulfonate in Group I/PIB mixed base stock).

Oil X5 comprised of 100% overbased calcium salicylate in Group III/PIB mixed base stock blended to a 21 $mm^2/s$ KV at 100° C. exhibited significant benefit at low speeds (10 mm/s or less) and high speeds (100 mm/s or more), but little or no benefit at intermediate speeds (between 10 and 100 mm/s) indicating that the preferred upper limit of kinematic viscosity at 100° C. is about 20 $mm^2/s$.

Reference Oil X4 (70 Base Number cylinder oil comprised of 100% overbased calcium phenate) in Group III/PIB blends provided a significant benefit in the moderate (10 mm/s) and high speed (100 mm/s) regions but less benefit in the low speed (less than 10 mm/s) region.

Referring to FIG. 3, it is shown that 70 base number cylinder oils comprised of a mixture of overbased calcium phenate (a desirable ingredient in these engine oils for other performance reasons) and overbased calcium salicylate (Oil X9) or a mixture of overbased calcium phenate and overbased calcium carboxylate (Oil X10 and Oil X12) in Group III/PIB blends all showed a benefit over Reference Oil C (a mixture of calcium phenate and calcium sulfonate in a Group I/PIB blend) and Reference Oil F (a mixture of calcium phenate and calcium salicylate in a Group I/PIB blend) over the entire speed range, the benefit becoming more pronounced at a speed of 10 mm/s and higher. Oil X13 which comprised a mixture of overbased calcium phenate and calcium salicylate in a mixture of Group II/PIB showed a benefit over Reference Oil C and Reference Oil F only at higher speed, about 60 mm/s and higher.

Oils X11, X12 and X13 were all run on a different, second MTM machine unit under the same test conditions as all the other runs. X11 is seen to be an outlier. Results on Oils X12 and X13 run on the same second MTM machine fall in line with the other samples evaluated in the first MTM machine unit, thus confirming that results from different units are substantially similar and comparable. The outlier is believed to reflect either a test or blending error.

Comparing Oil X12 to Oil X10, it is seen that blends employing higher molecular weight PIB in the bimodal blend provide a greater Traction Coefficient benefit under moderate speed to high speed (10 mm/s to 100 mm/s and higher).

What is claimed is:

1. A method for improving the fuel economy of large low and medium speed engines that reach surface speeds of at least 10 mm/s and are lubricated by an engine oil by reducing the traction coefficient of the engine oil used to lubricate the engine by employing as the engine oil a lubricating oil having a kinematic viscosity at 100° C. of 8 to 25 $mm^2/s$, comprising a base oil comprising a bimodal blend of two different base oils, the first base oil being one or more oils selected from Group III base oil and Group IV base oil, which first base oil has a kinematic viscosity at 100° C. of 2 to 12 $mm^2/s$ and a second base oil selected from one or more polyisobutylenes (PIBs) having a number average molecular weight of at least 1300 Mn and kinematic viscosity at 100° C. of at least 630 $mm/s^2$, and a detergent present in the range 8 to 25 wt % based on active ingredient selected from a mixture of alkali and/or alkaline earth metal phenate and salicylate, or a mixture of alkali and/or alkaline earth metal phenate and carboxylate with a total base number ranging from 40 to 400 mg KOH/g, wherein the improvement in fuel economy is evidenced by the engine oil having a traction coefficient which is lower than the traction coefficient of engine oils which are not bimodal or which are based on one or more Group I base stocks or on a mixture of Group I base stocks and PIB.

2. The method of claim 1 wherein the lubricating oil has a kinematic viscosity at 100° C. in the range 8 to 22 $mm^2/s$.

3. The method of claim 1 wherein the PIB has a number average molecular weight in the range 2500 to 6,000 Mn.

4. The method of claim 1 wherein the first base stock is Group III base stock.

5. The method of claim 1 wherein the first base stock is a Group IV base stock.

6. The method of claim 5 wherein the Group IV base stock is a PAO made employing metallocene catalysis.

7. A method for improving the fuel economy of large low and medium speed engines that reach surface speeds of at least 3 mm/s and are lubricated by an engine oil by reducing the traction coefficient of the engine oil used to lubricate the engine by employing as the engine oil a lubricating oil having a kinematic viscosity at 100° C. of 8 to 25 $mm^2/s$, comprising a base oil comprising a bimodal blend of two different base oils, the first base oil being one or more oils selected from Group III base oil and Group IV base oil, which first base oil has a kinematic viscosity at 100° C. of 2 to 12 $mm^2/s$ and a second base oil selected from one or more polyisobutylenes (PIBs) having a number average molecular weight of at least 1300 Mn and a kinematic viscosity at 100° C. of at least 630 $mm/s^2$, and a detergent present in the range 8 to 25 wt % based on active ingredient selected from a mixture of alkali and/or alkaline earth metal phenate and salicylate, or a mixture of alkali and/or alkaline earth metal phenate and carboxylate with a total base number ranging from 40 to 400 mg KOH/g, wherein the improvement in fuel economy is evidenced by the traction coefficient of the engine oil being lower than the traction coefficient of engine oils which are not bimodal or which are not bimodal to the same degree as recited or which are based on Group I and PIB base stocks even when containing detergent.

8. The method of claim 7 wherein the lubricating oil has a kinematic viscosity at 100° C. in the range 8 to 22 $mm^2/s$.

9. The method of claim 7 wherein the NB has a number average molecular weight in the range 2500 to 6,000 Mn.

10. The method of claim 7 wherein when the detergent is a combination of alkali and/or alkaline earth metal phenate and salicylate or a combination of alkali and/or alkaline earth metal phenate and carboxylate the weight ratio of phenate to salicylate or carboxylate is in the range 95:5 to 5:95.

11. The method of claim 10 wherein the weight ratio of phenate to salicylate or carboxylate is in the range 3:1 to 1:3.

12. The method of claim 7 wherein the first base stock is Group III base stock.

13. The method of claim 7 wherein the first base stock is a Group IV base stock.

14. The method of claim 13 wherein the Group IV base stock is a PAO made employing metallocene catalysis.

15. A method for improving the fuel economy of large low and medium speed engines that reach surface speeds of at least 60 mm/s by reducing the traction coefficient of the engine oil used to lubricate the engine by employing as the engine oil a lubricating oil having a kinematic viscosity at 100° C. of 8 to 25 $mm^2/s$, comprising a bimodal blend of two different base oils, the first being one or more oils selected from Group II base oil, Group III base oil and Group IV base oil, which first base oil has a kinematic viscosity at 100° C. of 2 to 12 $mm^2/s$ and a second base oil selected from one or more polyisobutylenes (PIBs) having a number average molecular weight of at least 1300 Mn and a kinematic viscosity at 100° C. of at least 630 $mm/s^2$, and a detergent present in the range 8 to 25 wt % based on active ingredient selected from a mixture of alkali and/or alkaline earth metal phenate and salicylate, or a mixture of alkali and/or alkaline earth metal phenate and carboxylate with a total base number ranging from 40 to 400 mg KOH/g, wherein the improvement in fuel economy is evidenced by the engine oil having a traction coefficient which is lower than the traction coefficient of engine oils which are not bimodal or which are based on one or more Group I base oils or which are a mixture of Group I base oil and PIB.

16. The method of claim 15 wherein the PIB has a number average molecular weight in the range 2500 to 6,000 Mn.

17. The method of claim 15 wherein when the detergent is a combination of alkali and/or alkaline earth metal phenate and salicylate or a combination of alkali and/or alkaline earth metal phenate and carboxylate the weight ratio of phenate to salicylate or carboxylate is in the range 95:5 to 5:95.

18. The method of claim 17 wherein the weight ratio of phenate to salicylate or carboxylate is in the range 3:1 to 1:3.

19. The method of claim 15 wherein the first base stock is Group III base stock.

20. The method of claim 15 wherein the first base stock is a Group IV base stock.

21. The method of claim 20 wherein the Group IV base stock is a PAO made employing metallocene catalysis.

* * * * *